US005698032A

United States Patent [19]

Weis

[11] Patent Number: 5,698,032

[45] Date of Patent: Dec. 16, 1997

[54] APPARATUS FOR PRODUCING MARBLEIZED SURFACES

[76] Inventor: Carl Weis, 69 Huntersfield Rd., Delmar, N.Y. 12054

[21] Appl. No.: 285,203

[22] Filed: Aug. 3, 1994

[51] Int. Cl.[6] ..... B05C 3/00

[52] U.S. Cl. ..... 118/402; 427/280; 427/281

[58] Field of Search ..... 427/280, 281; 118/402; 4/585, 593, 506

[56] References Cited

U.S. PATENT DOCUMENTS

| | | | |
|---|---|---|---|
| 304,802 | 9/1884 | DeWar . | |
| 503,661 | 8/1893 | Gnuchtel . | |
| 605,244 | 6/1898 | Callow | 427/280 |
| 1,209,342 | 12/1916 | Sealander . | |
| 1,416,325 | 5/1922 | Berry . | |
| 1,774,781 | 9/1930 | Witten . | |
| 1,931,667 | 10/1933 | Loetscher . | |
| 2,140,498 | 12/1938 | Dreyer . | |
| 2,373,211 | 4/1945 | Waldie . | |
| 2,483,789 | 10/1949 | Smith et al. | 4/585 |
| 3,755,830 | 9/1973 | Johns | 4/177 |
| 4,378,387 | 3/1983 | Mitchell . | |
| 4,485,502 | 12/1984 | Marcanio | 4/585 |
| 4,490,413 | 12/1984 | Stimson . | |

FOREIGN PATENT DOCUMENTS 18789 of 1898 United Kingdom .

*Primary Examiner*—Brenda A. Lamb

*Attorney, Agent, or Firm*—Schmeiser, Olsen & Watts

[57] ABSTRACT

A method and apparatus for producing marbleized surfaces is disclosed herein. The apparatus for producing the marbleized surfaces included a liquid containment vessel or bath, stretches and a wide variety of combs for use in the marbleizing process. A coloring composition is applied by floating it on the surface of the bath. One of the variety of marbling combs is swept across the surface of the bath to produce marbleized patterns. Material is then placed on the surface of the bath to transfer the marbleized patterns to the material.

5 Claims, 5 Drawing Sheets

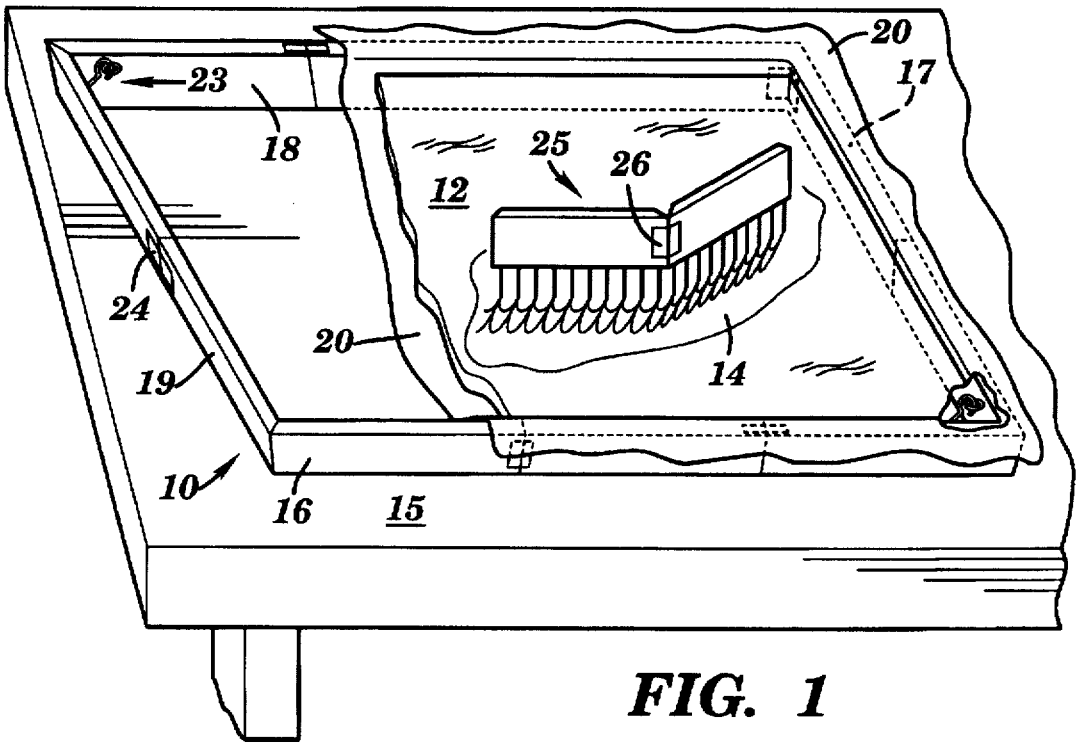
FIG. 1
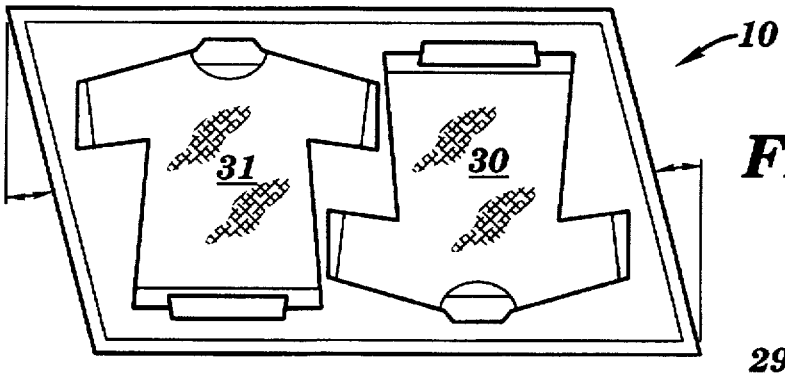
FIG. 2
FIG. 3
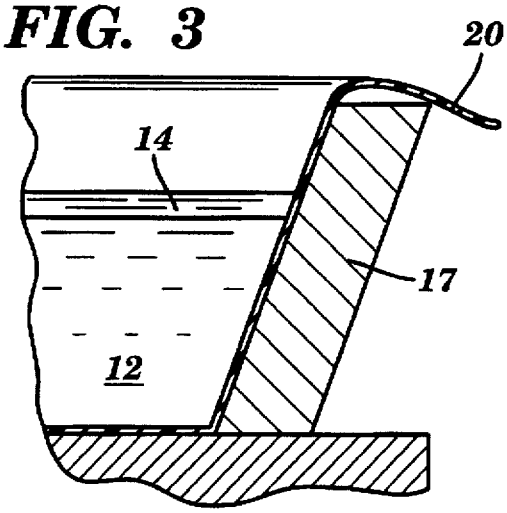
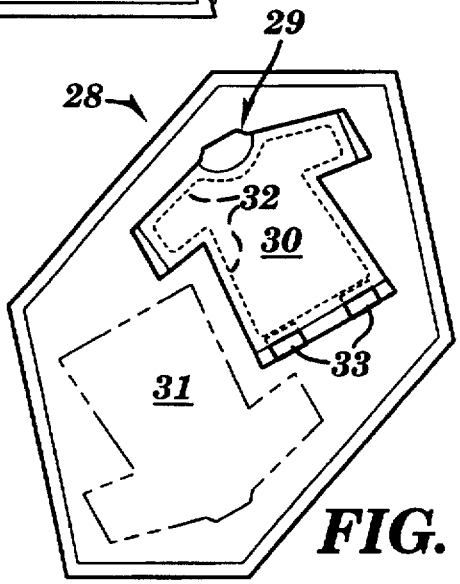
FIG. 4

FIG. 18
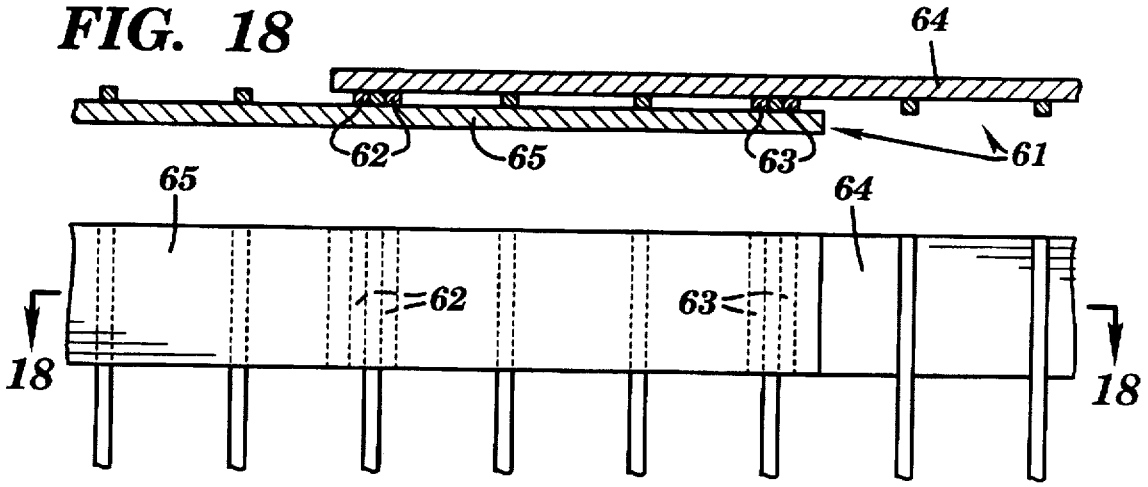
FIG. 19
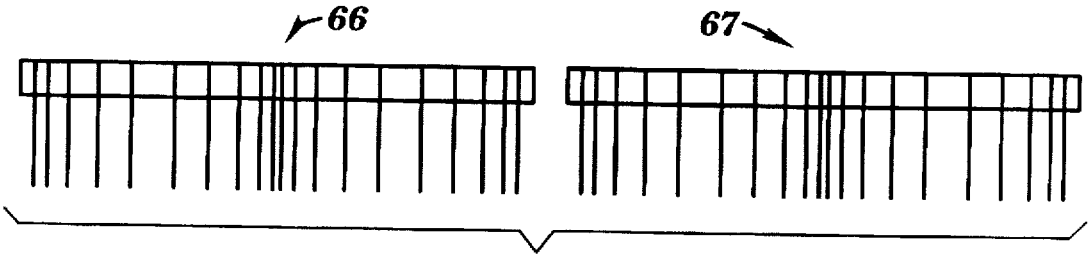
FIG. 20
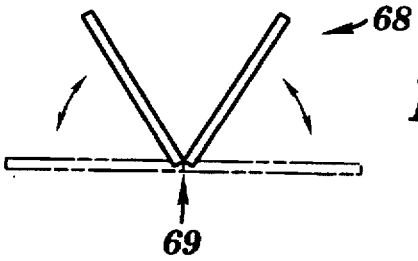
FIG. 21
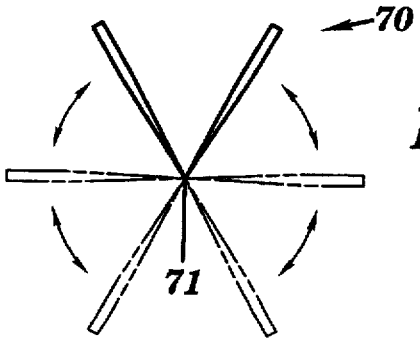
FIG. 22

APPARATUS FOR PRODUCING MARBLEIZED SURFACES

FIELD OF THE INVENTION

The present invention relates generally to the application of coloring compositions, such as paint, dye or ink to material, such as cloth. In particular, the present invention is concerned with a method and apparatus for marbleizing clothing and other surfaces by transfer of the coloring composition, as patterned by combing devices, floating on a liquid to the material.

BACKGROUND OF THE INVENTION

Heretofore, marbling generally relates to a technique for decorating clothing, paper, interior design articles, art works, novelty items and the like with arcuate and curvilinear flowing patterns to give an appearance similar to finished marble rock. Historically, the more common use of marbling was in the decoration of covers and edges of accounting books and ledgers.

Marbling techniques are disclosed in patents such as U.S. Pat. No. 4,378,387 which discloses a method of marbling decorated material through use of a specially constructed frame comb. The frame comb has staggered teeth with swollen portions for use in applying a coloring material to the surface of the bath. The swollen portions are used for applying to several points simultaneously on the surface, first a marbling ink and then an expanding agent to displace the ink to provide unique patterns.

U.S. Pat. No. 2,140,498 which illustrates an automated marbling process for treating a material such as fabric or paper. Water flows across a tank in which coloring material is placed by a color distributor. The coloring material and water flow through a comb disturber. The comb creates a marbling of the coloring material prior to application of the coloring material onto the fabric or paper.

Patents which illustrate various marbling applications include: U.S. Pat. No. 1,209,342 which uses a marbling technique for wall coverings. A powdered aluminum is floated on a bath after which glass is dipped therein. Water colors are then applied to the coated glass to give a marbleizing effect. U.S. Pat. 1,774,781 discloses a bath and chemicals for marbling rubber articles, such as toy balloons. U.S. Pat. No. 1,931,667 discloses process for marbling wallpaper.

U.S. Pat. Nos. 304,802 and 4,490,413 both disclose a method for marbling which includes floating a paint upon a bath of water. The paint is distributed on the bath by blowing the paint with air. The '802 patent has application in the glass making area, whereas '413 is used in making a painting.

U.S. Pat. No. 503,661 discloses a method of marbling enameled articles such as household kitchen utensils. The enamel is applied by a comb-like device.

U.S. Pat. No. 1,416,325 shows a rotary cutter having varying spaced cutters for producing a grain effect.

U.S. Pat. No. 2,373,211 teaches a method of producing marbled wrinkle finishes.

The above related art summaries are merely representative of portions of the inventions disclosed in each reference. In no instance should these summaries substitute for a thorough reading of each individual reference.

One of the difficulties of the prior art devices is that they do not disclose a marbling system which offers a wide variety of combs for utilizing various techniques to produce patterns and designs.

Another disadvantage is the portability and storage of the present systems. The present systems include large pans or tubs for holding the marbling bath which are bulky for transportation and storage purposes.

SUMMARY OF THE INVENTION

The present invention includes a method and apparatus for producing marbleized patterns upon clothing and other surfaces which overcomes the disadvantages of the prior devices while still retaining the advantages thereof. In particular, the present invention includes a marbling liquid containment vessel or bath, clothing stretchers and a wide variety of combs for use in the marbleizing process.

The marbling liquid containment vessel is collapsible for efficient use and ease of transportation and storage. The clothing stretchers are also collapsible for efficient use, transportation and storage. The wide variety of combs provide the means for achieving unique marbleizing patterns. For example, a U-shaped tip or the curving teeth and other features of the bear claw comb provides 3-dimensional illusions when used in a certain manner. In another example, the butterfly comb yields a unique kind of symmetrical pattern owing to its hinged spine. As the combs are moved through the coloring composition, a variety of flowing, curvilinear, parabolic, and many more kinds of patterns are produced that are fundamentally different from patterns obtained using traditional combs and rakes.

BRIEF DESCRIPTION OF THE DRAWINGS

These and other advantages of the present invention will become more readily apparent upon reading the following detailed description and upon reference to the drawings in which:

FIG. 1 is a perspective view of a marbling bath of the present invention;

FIG. 2 is a plan view of the marbling bath of the present invention;

FIG. 3 is a cutaway side view of the marbling bath of the present invention;

FIG. 4 is a plan view of a second embodiment of a marbling bath of the present invention;

FIG. 18 is a front view of the two-part comb of the present invention;

FIG. 19 is a front view of a variable space teeth comb of the present invention;

FIG. 20 is a top view of a butterfly comb of the present invention;

FIG. 21 is a top view of an osprey comb of the present invention;

FIG. 22 is a perspective view of a bear claw comb of the present invention.

DETAILED DESCRIPTION OF THE PREFERRED EMBODIMENTS

Figure 5:
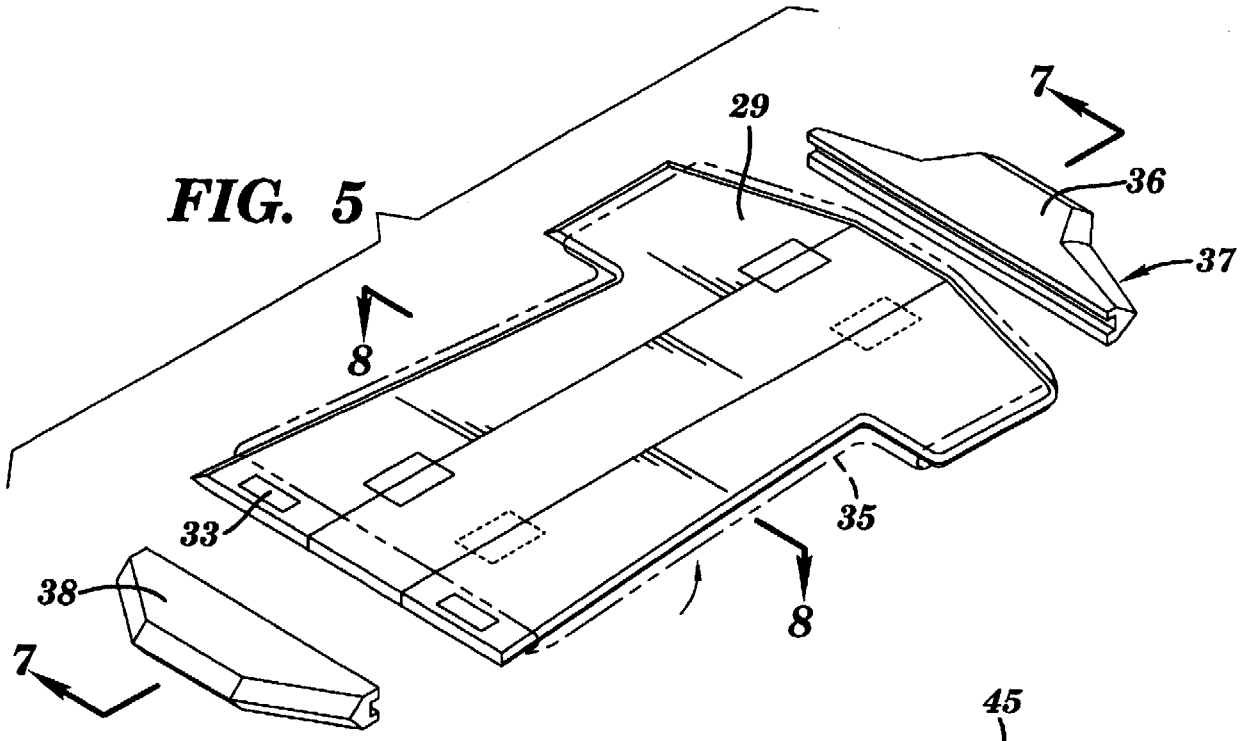
FIG. 5 is a front view of an inflatable stretcher of the present invention.

FIG. 1 illustrates the marbling liquid containment vessel or bath 10 of the present invention. The marbling liquid containment vessel 10 includes a sidewalls 16, 17, 18, 19. The sidewalls of the marbling bath 10 are fastened by hinges 24 and hook and loop fasteners 23. Other types of fasteners and connecting devices are contemplated such as male/female joints, telescoping sections or the like. The hinges 24 and hook and loop fasteners 23 allow for compact folding of the sidewalls 16, 17, 18, 19 for storage and transportation. The base 15 of the bath may be a table top, a board, or other planar surface over which the sidewalls 16, 17, 18, 19 are placed. A polyethylene sheet 20 is placed over the sidewalls. The polyethylene sheet 20 provides an impermeable liquid barrier to prevent leakage from the bath 10. As the bath 10 is filled, the hydraulic pressure of the liquid 12 pushes the polyethylene sheet 20 firmly against the sidewall as shown in FIG. 3. The liquid 12 in the marbling bath 10 is preferably water thickened with methyl cellulose. Paint, ink or other coloring agent 14 is applied to the surface of the liquid 12 with a dropper or other liquid dispersing device (not shown). Illustrated in center of the bath is a butterfly comb 25.

FIG. 2 is a top view of the marbling bath 10. The marbling bath 10 is shaped as a parallelogram for maximum placement conversation of the area in which coloring agent and liquid is needed. During the marbling operation, a first side of a shirt 30 is marbled after which it is turned over for marbling the opposite side 31.

FIG. 3 shows a cutaway side view of the marbling bath 10. The polyethylene sheet 20 is fastened to the side 17, 19, front 16, and back 18 preferably by the hydraulic pressure of liquid 12. This allows for ease of assembly and disassembly. The paint 14 is illustrated as floating on the liquid 12.

FIG. 4 shows an alternate bath arrangement 28 for maximum conservation of liquid and coloring agent in the form of a six sided polygon as an alternate marbling bath 28. Other types of bath designs and shapes are contemplated depending upon the article being marbled. Shown in the alternate marbling bath 28 is first side 30 and a second side of a shirt 31 mounted on a hinge-type stretcher 29. On the hinge-type stretcher 29 may be placed a strip of newspaper 32 so that the coloring agent 14 in the marbling bath is not transferred through the hinge joint to the other side of the fabric. On the lower portion of the stretcher 29 are fastening elements 33. The fastening elements 33 are material such as VELCRO®, (a hook and loop fastener), tape, snaps, clips or the like.

Figure 23:
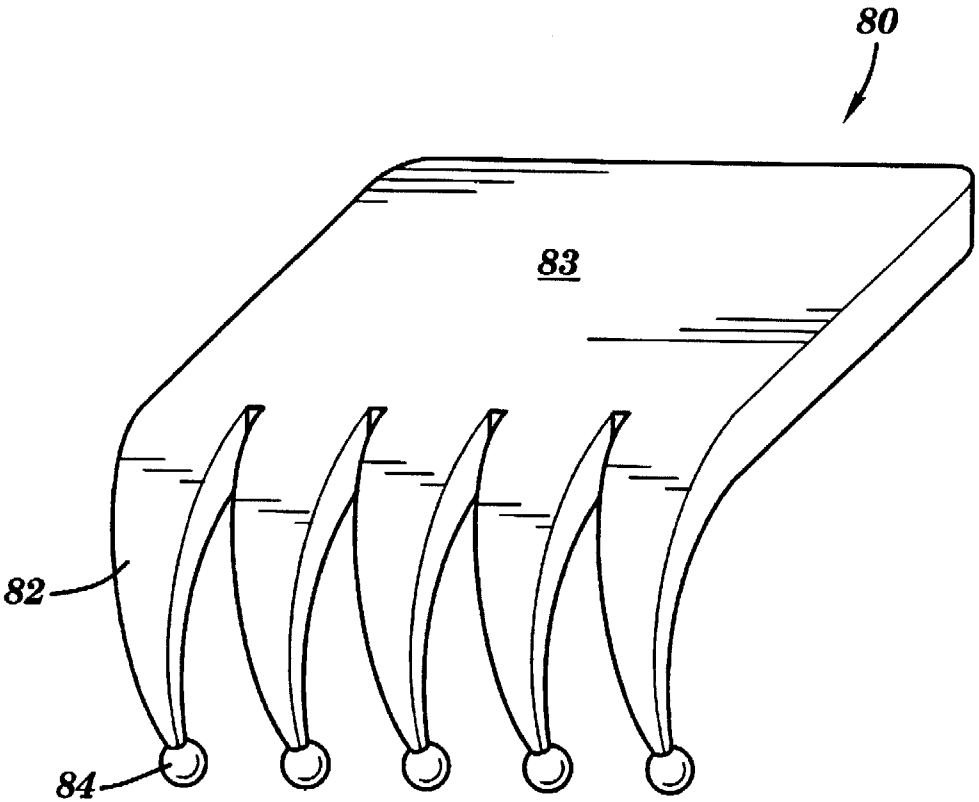
FIG. 23 is a cutaway view of lines 5—5 of FIG. 5.

An inflatable stretcher shown in FIGS. 5 and 23 is preferably a ribbed bladder 34. The bladder 34 includes a tapered edge 90 to provide a smooth transition between a first side 30 and a second side 31 of the article being marbleized, to prevent areas of uncolored or overlapped colors on the fabric. An inflation nipple 34A is used to inflate the bladder 34. The bladder 34 includes ribs 91 which provide a flat surface for even application of the coloring composition during marbling. The inflatable bladder 34 may be deflated for easier insertion into articles of clothing and to facilitate transportation and storage.

Figure 6:
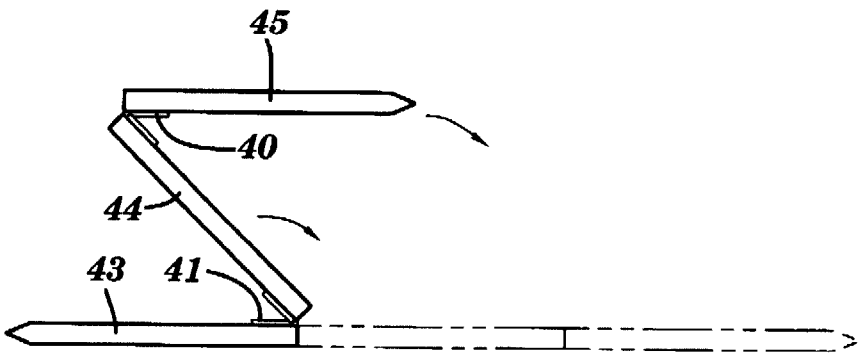
FIG. 6 is a perspective view of a hinged stretcher of the present invention.
Figure 7:
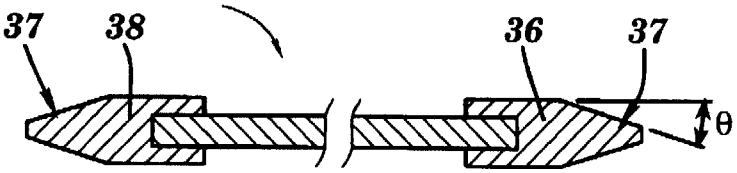
FIG. 7 is a cutaway side view through lines 7—7 of FIG. 6 of the hinged stretcher of the present invention.
Figure 8:
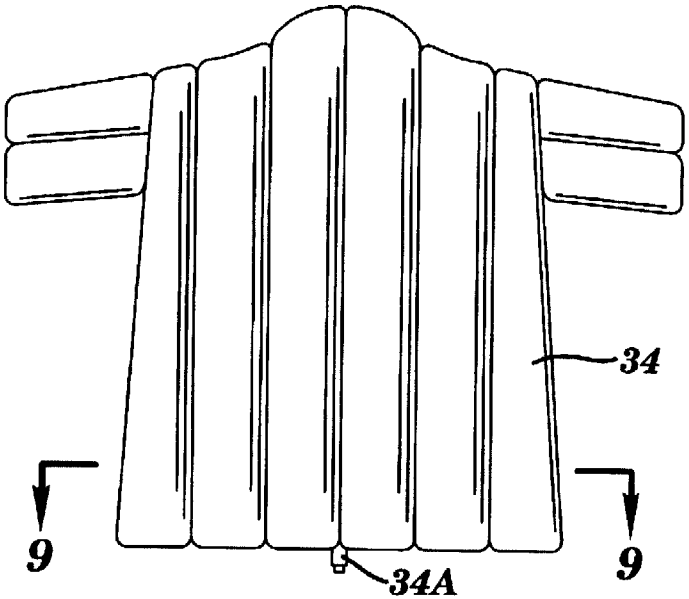
FIG. 8 is a cutaway view through lines 8—8 of FIG. 6 of the hinged stretcher of the present invention.

FIGS. 6–8 illustrates a hinge-type stretcher 29. As shown in FIG. 6, the hinge-type stretcher 29 includes a upper retention board 36 and a lower retention board 38 to prevent the stretcher 29 from folding during the marbling process. For storage, the hinged stretcher 29, as shown in FIG. 8 can be folded into a compact position. In operation, the hinged stretcher while in the compact position is inserted into a shirt 35 and then unfolded to stretch the shirt 35 out. Next, the retention boards 36, 38 are inserted on the stretcher to prevent it from folding. The hinge-type stretcher includes a first outer portion 43, a center portion 44 connected by hinge 41 and a second outer portion 45 connected by hinge 40.

Referring to FIG. 7, the outer edges of the first outer portion 43, the second outer portion 45 and the retention board 36 include a beveled edge 37 to provide a smooth transition between the first side 30 and second side 31 of the material being marbled so as not to have overlapping colored fabric or uncolored fabric at the edge of the material after the marbleizing process. The upper and lower portions of the bevel 37 have an angle θ which is about 15° to 20° with respect to a longitudinal axis of the stretcher 29.

Figure 9:
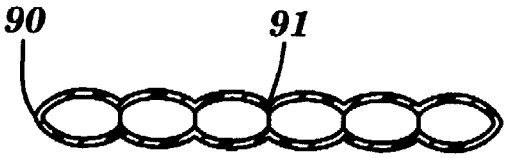
FIG. 9 is a top view of a marbling comb.
Figure 10:
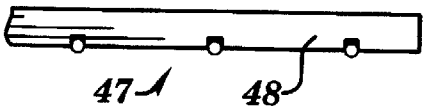
FIG. 10 is a front view of a marbling comb.

FIG. 9 shows a top view of a marbling comb 47. The marbling comb 47 includes a spine 48 and a teeth 51. As shown in FIG. 10 teeth 50 include shanks 53 having tips 51 thereon. The teeth 50 are fastened to the spine 48.

Figure 11:
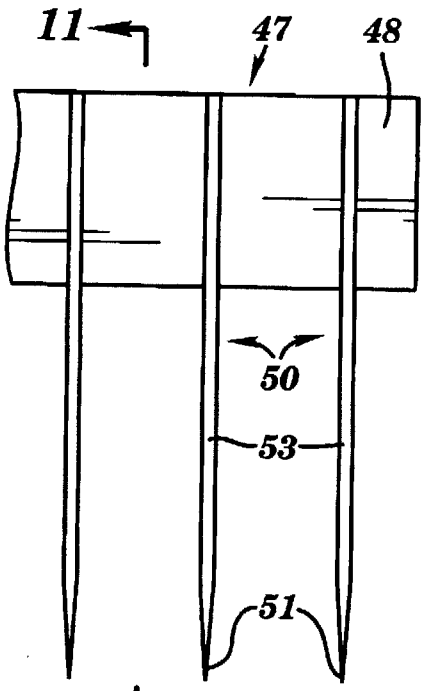
FIG. 11 is a cutaway side view through lines 11—11 of FIG. 10 of a marbling comb.

FIG. 11 is a cutaway side view of the marbling comb 47 as taken through section 10—10 of FIG. 10.

Figure 12:
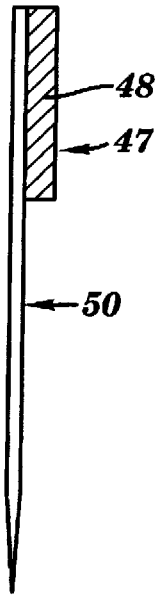
FIG. 12 illustrates an alternate embodiment of the tips of the teeth of a marbling comb of the present invention.

Modified tips 52, 54 are shown in FIG. 12. The U-shaped tip 52 is used for variable width combing. As the U-shaped tip 52 is placed deeper in the bath during combing of the coloring composition, the width of the comb has a closer spacing across the U then when the tip is raised from the bath. This provides variation of combing width during a single sweep of the comb. Other tip configurations are also contemplated to provide a similar effect such as a V-shaped comb, a trident-shaped comb and the like.

The arrowhead tip 54 provides a 3-dimensional illusion on the marbleized surface. As the tip 54 is combed across the surface of the coloring composition, it gathers coloring composition. After sufficient paint has been gathered on the tip 54, it is raised above the surface of the bath and the gathered paint drips back over the marbleized surface to create 3-dimensional illusion. Other tip designs are also contemplated which provide a 3-dimensional illusion. For example, the bear claw comb 80 (FIG. 22) includes tips 84 which gather coloring composition as the comb is swept through the bath. As the tips are pulled out of the bath and swept above the surface, the gathered paint drips onto the pattern creating a 3-dimensional illusion. The curved shanks 82 are V-shaped and may be used to gather additional coloring composition during the sweeping motion.

Tips 52, 54 may be placed in a sliding groove on the spine 48 for rotation of the tip to vary its width or for sliding in a manner perpendicular to the spine 43 for engagement and disengagement of various tips along a given spine.

Figure 13:
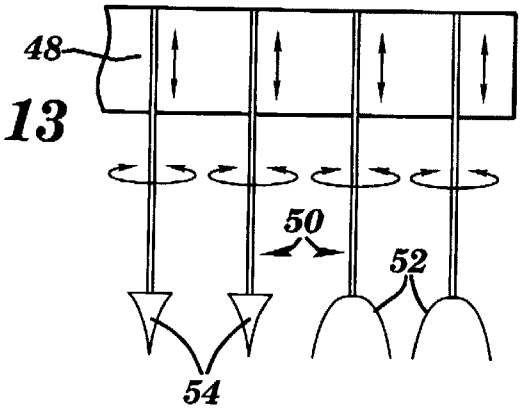
FIG. 13 is a tepee comb of the present invention.

FIG. 13 is a tepee comb 55 having a curved spine 57. The tepee comb 55 provides unique patterns. For example, as the comb is swept across the coloring composition, the apparent distance of the teeth are closer together on the outer edges than the inner edges.

Figure 14:
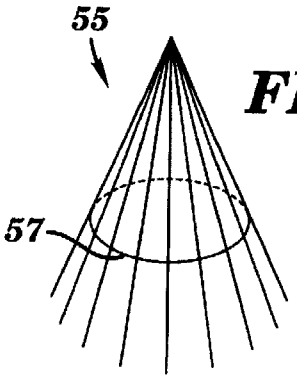
FIG. 14 is a top view of a flexible comb of the present invention.
Figure 15:
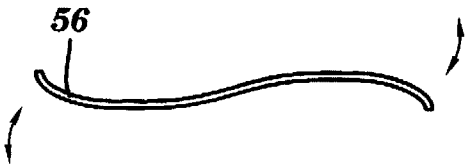
FIG. 15 is a front view of a flexible comb of the present invention.

The comb shown in FIGS. 14 and 15 is a water moccasin comb. This comb includes either a flexible or rigid spine 56. When the spine is flexible, it may be swept across the surface of the coloring composition in an undulated manner to provide varying spacing of teeth based on the angle of the spine 56. When the spine 56 is rigid, the comb may similarly be moved in a back and forth manner to provide varying spacings in the pattern of the coloring composition.

Figure 16:
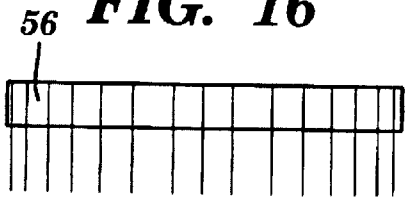
FIG. 16 is a front view of a comb having slidable teeth of the present invention.

FIG. 16 discloses a marbling comb having a spine 58 with slidable teeth 60. The teeth 60 may be placed on a form 59 so that the teeth may be varied in height such that during a sweep of the comb, certain teeth are positioned in the bath and others are out of the bath. This comb also allows for variation in spacing. For example, one out of every seven teeth may be activated for combing, or for a wider spacing, one out of every ten teeth may be activated.

Figure 17:
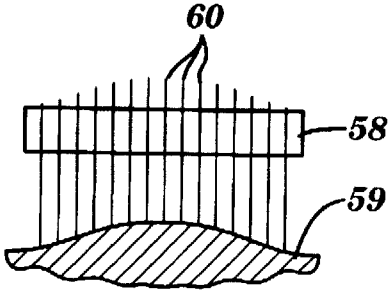
FIG. 17 is a top view of a two-part comb of the present invention.

FIGS. 17 depicts marbling combs 61 joined together. The marbling combs 61 are joined to increase or decrease the sweep of the comb. The joined marbling comb 61 includes spines 64, 65, and teeth fastening strips 62, 63. In addition to fastening strips 62, 63, the spines 64, 65 may be connected in other manners such as tape, clips, snaps, VELCRO®, a hook and loop fastener, or the like.

FIG. 18 illustrates marbling combs 66, 67 with variable spaced teeth. The variable spaced teeth combs 66, 67 create unique dynamic patterns different from those of traditional combs in which the teeth are regularly spaced. The combs 61 or 66, 67 may also be connected to slide parallel with respect to one another in a telescoping manner as a different means for varying the teeth spacing.

FIGS. 20 and 21 illustrate various manners in which combs may be hinged to one another. FIG. 20 shows a butterfly comb 68. The hinged butterfly comb 68 enables unique symmetric patterns when alternately opened and closed during combing. The butterfly comb includes a one-way hinge 69. FIG. 21 is a double hinged osprey comb 70. The osprey comb 70 is hinged at 71 and provides unique symmetrical patterns during dull sweeps.

It is also within the spirit of the present invention to provide a computer program to simulate the unique marbleized patterns of the aforementioned kit and its associated combs. For example, a program may be written as a screen saver which has continuously or intermittently changing marbleized patterns from a butterfly comb or a water moccasin comb or any other individual comb or combination of combs. Additionally, a program may be written to simulate the aforementioned marbling bath and the combs associated therewith so that one may arrive at unique marbleized patterns on a computer screen or any printouts therefrom on fabric or other material.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

What is claimed is:

1. A kit for producing marbleized surfaces comprising:

a collapsible marbling liquid containment vessel;

a plurality of marbling combs, each of said combs having a spine and at least one tooth with a shank and a tip thereon, wherein said plurality of combs are selected from the group consisting of:

a comb having at least one tooth having a shank curving outwardly from said spine and a tip with a curved surface; a comb having a flexible spine; a comb having a curved spine; a comb having at least one tooth slidably mounted on said spine; a comb having a plurality of variably spaced teeth; and a comb comprised of a plurality of spines joined together in an end-to-end manner;

a collapsible stretcher, said collapsible stretcher including at least two sections hinged together on an inner periphery of said sections and at least a portion of an outer periphery having a beveled surface; and a retention board connectable to said at least two hinged sections for rigidly holding said at least two hinged sections.

2. The kit of claim 1, wherein the collapsible marbling liquid containment vessel includes:

a plurality of sidewall sections joined by connectors; and an impermeable liner positioned over said sidewall sections.

3. The kit of claim 1 wherein the plurality of spines joined together in an end-to-end manner is selected from the group consisting of: a butterfly comb; an osprey comb; and a sliding comb.

4. A kit for producing marbleized surfaces comprising:

a collapsible marbling liquid containment vessel;

a plurality of marbling combs, each of said combs having a spine and at least one tooth with a shank and a tip thereon, wherein said plurality of combs are selected from the group consisting of:

a comb having at least one tooth having a shank curving outwardly from said spine and a tip with a curved surface; a comb having a flexible spine; a comb having a curved spine; a comb having at least one tooth slidably mounted on said spine; a comb having a plurality of variably spaced teeth; and a comb comprised of a plurality of spines joined together in an end-to-end manner; and an inflatable stretcher.

5. A kit for producing marbleized surfaces:

a marbling liquid containment vessel;

a plurality of marbling combs, each of said comb having a tube with a shank and a tip thereon;

a collapsible stretcher, said collapsible stretcher including at least two sections hinged together; and a retention board connectable to said hinged sections for holding said at least two hinged sections.

* * * * *